US006090157A

United States Patent [19]

Traut et al.

[11] Patent Number: 6,090,157

[45] Date of Patent: Jul. 18, 2000

[54] PROCESS AND DEVICE FOR APPLICATION OF VAT DYE, ESPECIALLY INDIGO, TO A THREAD BUNDLE

[75] Inventors: Klaus Traut; Wolfgang Lange, both of Zell, Germany

[73] Assignee: Benninger AG, Uzwil, Switzerland

[21] Appl. No.: 09/016,286

[22] Filed: Jan. 30, 1998

[51] Int. Cl.[7] ..... D06B 3/10

[52] U.S. Cl. ..... 8/149.3; 8/151; 8/149.1; 68/5 C; 68/5 E

[58] Field of Search ..... 8/149.1, 149.3, 8/151; 68/5 E, 5 C

[56] References Cited

U.S. PATENT DOCUMENTS

| | | | |
|---|---|---|---|
| 2,142,909 | 1/1939 | Moncrieff et al. | 8/149.3 |
| 2,415,379 | 2/1947 | Vieira | 8/149.3 |
| 3,396,415 | 8/1968 | Windhorst | 8/149.3 |
| 3,401,412 | 9/1968 | Windhorst | 8/149.3 |
| 3,898,821 | 8/1975 | Kutz | 68/5 E |
| 4,104,893 | 8/1978 | Marchesini et al. | 68/5 E |
| 4,136,535 | 1/1979 | Audas | 68/5 E |
| 4,818,244 | 4/1989 | Iwami | 8/149.1 |
| 5,233,717 | 8/1993 | Weber et al. | 68/5 E |
| 5,634,226 | 6/1997 | Oschatz | 8/149.1 |

FOREIGN PATENT DOCUMENTS

| | | | |
|---|---|---|---|
| 2066994 | 11/1978 | Germany | 68/5 E |

*Primary Examiner*—Frankie L. Stinson
*Attorney, Agent, or Firm*—Shoemaker and Mattare, Ltd.

[57] ABSTRACT

In a process for the application of a vat dye, preferably indigo, to a thread bundle (1), before thread bundle (1) enters a dye liquor (3) it is run through a steam lock (5). Steam lock (5) is separated from a chamber (20) through which thread bundle (1) is run after leaving dye liquor (3) via a holding section (21) in an essentially oxygen-free atmosphere.

12 Claims, 3 Drawing Sheets

PROCESS AND DEVICE FOR APPLICATION OF VAT DYE, ESPECIALLY INDIGO, TO A THREAD BUNDLE

BACKGROUND OF THE INVENTION

The invention pertains to a process and the device with the features of the preamble to the independent patent claims.

In vat dyeing, textiles are dyed with so-called vat dyes, e.g., indigo, in a special dyeing process. Vat dyes are compounds with indigoid or anthrachinoid structures and are mostly insoluble. For dyeing, the vat dyes are first chemically reduced and transferred into a water-soluble fiber-affinity leuco-dye. The leuco-dye forms the dye liquor, which is also frequently referred to as a vat. The cloth that is to be dyed is generally steeped in the vat. Because of the high fiber affinity of leuco-dyes, the dyeing speed is high and can lead to rregularities, which can be corrected by adding equalizing agents or by raising the temperature. The textiles are then separated from the dye liquor and washed. Because of contact between the liquor-impregnated cloth and atmospheric oxygen or other oxidation agents, the initial dye builds back up through oxidation. Non-water-soluble dye that is produced during this oxidation process adheres very well to the thread, is extremely genuine, and cannot be further modified by atmospheric oxygen.

To produce textiles, warp thread bundles are frequently run through a steep bath filled with a dye liquor. The threads, which enter the liquor at high speed, entrain oxygen from the ambient air into the liquor, thus partially oxidizing the liquor even in the steep bath. This causes a great deal of dye to be consumed which can no longer be used for dyeing, but is simply lost.

Another problem with vat dyeing of threads lies in the fact that the liquor on the surface of the threads, which leave the dyeing liquor at high speed, are immediately oxidized by contact with the oxygen in the atmosphere. The dye is thus fixed on the surfaces of the threads but cannot penetrate into them.

The known way to keep the dye liquor from oxidizing in the steep bath is to supply the liquor with oxidation inhibiting agents. This raises concerns, however, from the ecological viewpoint. Another known way of preventing the dye liquor from oxidizing immediately on the surfaces of threads after leaving the steep bath is to run the threads through an inert-gas atmosphere immediately after leaving the liquor. If the threads remain in a non-oxidizing atmosphere for certain length of time, the liquor can penetrate into the threads sufficiently without being oxidized. Such an arrangement is known from, e.g., FR 1097607.

To prevent oxygen from being entrained by the threads when entering the dye liquor, the threads are also often treated with inert gas before making contact with the liquor. This is known from, e.g., U.S. Pat. No. 5,378,246 and U.S. Pat. No. 5,494,491.

DE 43 42 313 also teaches running the threads, before they enter the dyeing liquor, through the chamber, which is essentially oxygen-free. The purpose of this is to prevent oxygen from being entrained by the threads and incorporated into the dyeing liquor. This device is, however, associated with the disadvantage that the inert atmosphere (an inert gas such as nitrogen, or superheated steam) has to be kept under a certain pressure because of the openings in the housing. Since the housing that surrounds the oxygen-free atmosphere has two openings (entry and exit) for the yarn, the loss of inert gas is relatively large. Inert gas is, however, an important cost factor in the operation of such dyeing systems, and its consumption should therefore be kept as low as possible. Another disadvantage of such devices lies in the fact that, despite all efforts to the contrary, oxygen is able to penetrate into the essentially oxygen-free chamber through the entry lock in the form of a crushing mill. This has the effect that the holding section for the dyeing liquor to be absorbed into the yarn cannot be kept sufficiently oxygen-free, or can be kept so only at high cost.

SUMMARY OF THE INVENTION

The object of this invention is to avoid the disadvantages of the state of the art, i.e., especially to create a process and a device for applying vat dye to a thread bundle that can be operated in an economical and environmentally sound manner. In this process the intention is to reduce the consumption of inert gas and to avoid, as much as possible, having oxidation inhibiting agents be consumed in the dye liquor. Another purpose of the process and the device according to this invention is to ensure good fixing of the dye to the threads.

These objects are achieved with a process and device with the features presented in the characterizing part of the independent patent claims.

In a process for applying vat dye, especially indigo, to a thread bundle, the thread bundle is run through a steep bath that is filled with a dye liquor. After leaving the dye liquor, the thread bundle is run through a holding section in a chamber with an oxygen-free or low-oxygen atmosphere. As long as the thread bundle remains in this holding section in the low-oxygen or oxygen-free chamber, the dyeing liquor is not oxidized and is able to penetrate into the threads. Depending on the yarn speed, the holding section is selected in such a way that the thread bundle exits into the oxidizing ambient air only when the threads have been fully impregnated with dye liquor.

Before entering the dye liquor, the thread bundle is run through a steam lock. The steam lock extends essentially up to the surface of the dye liquor and, according to the invention, is separated from the chamber through which the thread bundle is run after leaving the steep bath. It is especially advantageous to provide such a steam lock because the consumption of inert gas in the chamber with the low-oxygen or oxygen-free atmosphere becomes independent of how the thread bundle enters the dye liquor. Therefore, as before, it is possible to work with nitrogen, which is relatively expensive, in the chamber without having to worry about the atmosphere becoming re-enriched with oxygen because of the incoming threads. The chamber can thus be kept oxygen-free or nearly so at low cost. On the other side, the steam lock can be made relatively small so that only a small volume of steam is required to form this lock. The use of steam is also more cost-effective and has additional advantages. In particular, it is advantageous that the hot steam, on the one hand, moistens and, on the other, heats the thread bundle before it enters the dye liquor. This improves the dyeing process as well as the uptake of the dye liquor into the threads.

In an especially advantageous process, the steam lock extends to a point right at the surface of the dye liquor. In another advantageous embodiment, toward the end of the steam lock the thread bundle is also run through at least one mechanical lock arrangement, e.g., in the form of sealing tabs. This also prevents oxygen from being entrained by the threads and carried into the dye liquor.

The device according to the invention for the application of vat dye to a thread bundle consist essentially of a steep bath for holding a dye liquor and an arrangement for guiding the thread bundle on a treatment path into and through the dye liquor. The device also has a chamber with an essentially oxygen-free atmosphere through which the treatment path runs after leaving the dye liquor. The purpose of the holding section that is thus formed in the low-oxygen or oxygen-free chamber is to cause the liquor to be absorbed into the threads. Only after the threads leave this chamber is the liquor fixed to the threads by oxidation. According to the invention, the device is equipped with a steam lock through which the treatment path runs before entering the dye liquor. The steam lock is separated from the low-oxygen or oxygen-free chamber. The physical separation of the steam lock from the oxygen-free chamber keeps oxygen entrained by the threads from being able to enter the chamber. The dye through which the thread bundle is run serves as an almost perfect gas seal between the steam lock, on the one hand, and the low-oxygen chamber, on the other.

In an especially preferred embodiment, the steam lock is formed by a channel that extends at least to the surface, and preferably to a point just below the surface, of the dye liquor. The design of the steam lock in the form of a channel is especially simple and efficient. At least at the start of the steam lock, there is preferably a sealing-tab arrangement in the channel as well. Because of these sealing tabs, the penetration of oxygen into the steam lock is prevented by mechanical means, thus leading to reduced steam consumption. It is also advantageous to place such a sealing-tab arrangement at the end of the steam lock.

In another, advantageous embodiment, the length of the steam lock is designed to be adjustable on the long side. The width can be adjusted. The length along the long side is thus determined based on the number of threads based on the number of threads in a thread bundle to be dyed.

The width of the steam lock is also advantageously selected depending on the diameter of the threads to be dyed. Ideally, the width of the lock is selected to be smaller than approximately five times the thread diameter, and preferably approximately two to four times the thread diameter. This ensures that knots in the threads cannot get caught in the lock.

In another embodiment, which is particularly simple in terms of structure, the one wall of the channel that forms the steam lock is designed as a continuation of the wall of the steep bath. From the structural standpoint, such an arrangement is especially advantageous.

BRIEF DESCRIPTION OF THE DRAWINGS

The invention is explained in greater detail below with reference to the drawings, in which.

DESCRIPTION OF THE PREFERRED EMBODIMENT(S)

Figure 1:
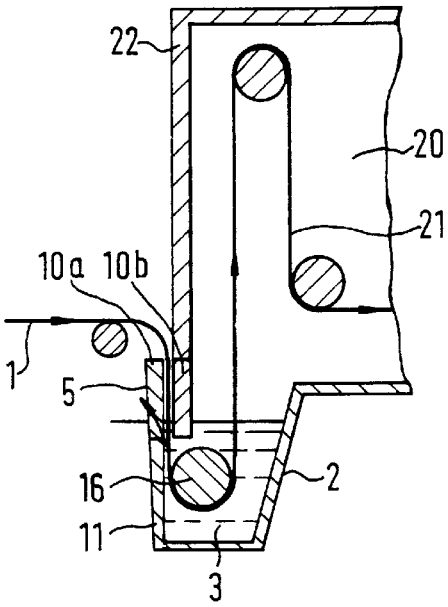
FIG. 1 shows a schematic of a device according to the invention.

FIG. 1 shows a device according to the invention for applying vat dye to a thread bundle 1. Thread bundle 1 is run through a steep bath 2, which holds a dye liquor 3. After leaving dye liquor 3, thread bundle 1 is run in a chamber 20 through a holding section 21 where the dye liquor can penetrate thoroughly into the threads without being oxidized. Thread bundle 1 is run through a steam lock 5 before entering dye liquor 3. The steam lock keeps the threads from pulling oxygen into the liquor. In addition, the threads are heated and wetted in the steam lock. The thread bundle is run through the dyeing arrangement via deflection rollers 16. Said rollers are not, however, an object of this invention.

Figure 2:
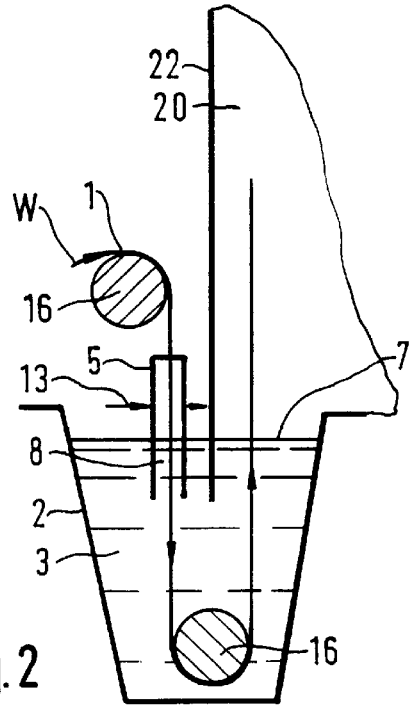
FIG. 2 shows a more detailed view of the device according to the invention in the area of the steam lock.
Figure 3:
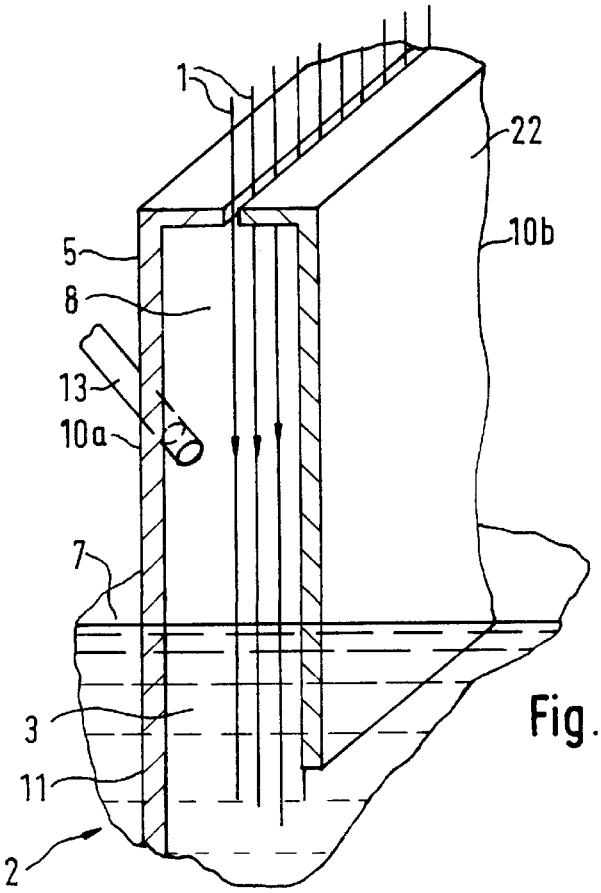
FIG. 3 shows a detail of a section of the steam lock in cross-section.

FIG. 2 shows a more detailed view of the steam lock according to the invention. Steam lock 5 is arranged in such a way that it extends to a point below surface 7 of dye liquor 3. This prevents the threads from being able to come into contact with oxygen before they enter the liquor and incorporating oxygen into the liquor. The steam lock is designed in the shape of a canal that is bounded by two side walls 10*a*, 10*b*. After it leaves dye liquor 3, thread bundle 1 is guided into a chamber 20 in which there is a low-oxygen or oxygen-free atmosphere. Nitrogen is preferably used to produce this atmosphere. Outer wall 22 of chamber 20 also extends to a point below surface 7 of dye liquor 3. This ensures good sealing of chamber 20 in the area where thread bundle 1 enters chamber 20. The exact design of chamber 20, and especially the exit lock, are well known to one skilled in the art and will not be described in detail. For the sake of simplicity, in FIG. 2 walls 10*a*, 10*b* of channel 8, as well as walls 22 of chamber 20 and edge 11 of steep bath 2, have been depicted as individual components. As FIG. 1 shows, however, in an especially simple design variant wall 10*a* of channel 8 can be designed as a continuation of side wall 11 of steep bath 2, and other wall 10*b* of lock 5 can be designed as part of wall 22 of chamber 20. FIG. 3 shows a detailed view of a steam lock 5 that is designed in this way.

Steam lock 5 consist essentially of a channel 8, which is bounded by two walls 10*a*, 10*b*. One wall 10*a* forms the continuation of side wall 11 of steep bath 2 for holding dye liquor 3. Other side wall 10*b* simultaneously forms wall 22 of chamber 20, through which thread bundle 1 is run after leaving dye liquor 3. The entry into steam lock 5 is also preferably equipped with a mechanical obstacle that impedes the entry of oxygen. Superheated steam is admitted via a feed 13 into channel 8 of steam lock 5. It is not absolutely necessary to provide an offtake for the steam. Supplying steam at a pressure that is slightly above ambient pressure causes steam to discharge through openings, thus preventing oxygen from entering through the said openings. This is especially advantageous if, in the area where threads 1 enter the steam lock, the steam is able to exit in the direction opposite that in which the threads run.

Figure 4:
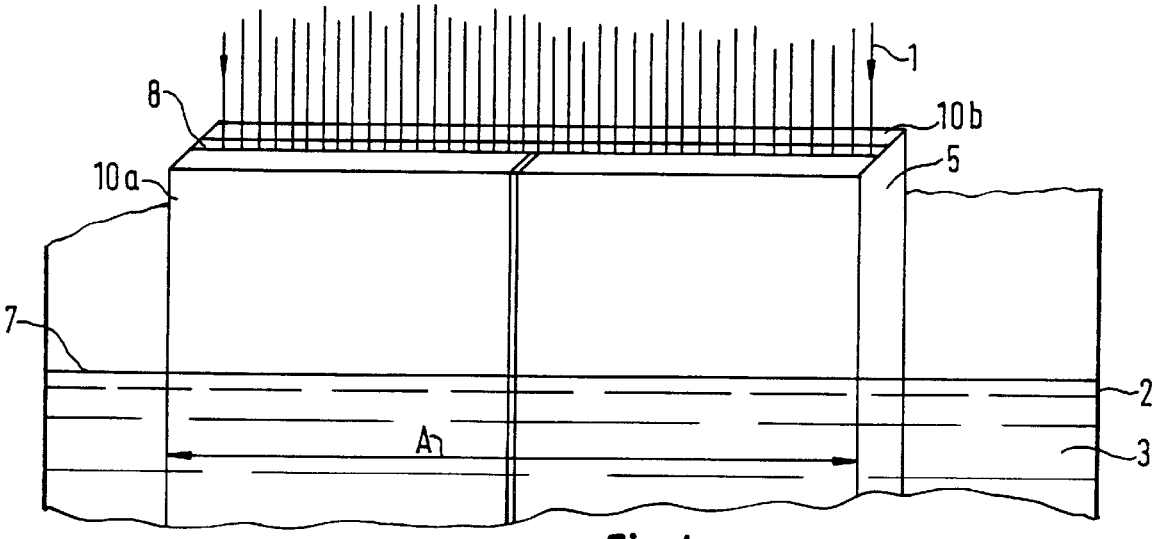
FIG. 4 shows a view of the long side of a schematically depicted steam lock.

FIG. 4 shows a schematic view of thread bundle 1 entering the lock. Steam lock 5 is schematically depicted by a channel that is formed by two walls 10*a*, 10*b* and that, of course, must be closed at the sides. Steam lock 5 extends to a point just below surface 7 of dye liquor 3, which is contained in steep basin 2. FIG. 4 shows length A of steam lock 5. Steam lock 5 is shaped in such a way that its length A can be adjusted. Thus the steam lock can be adapted to the requirements imposed in each case, in particular to the number of threads in the thread bundle to be dyed.

Figure 5:
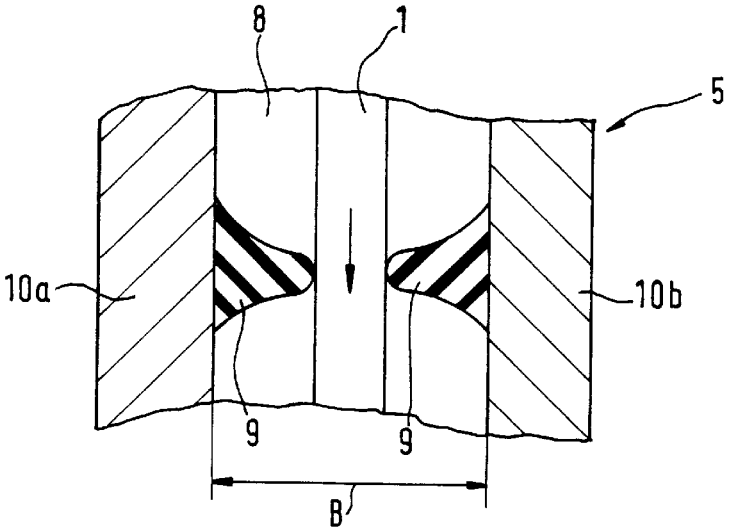
FIG. 5 shows a schematic of a sealing-tab arrangement.

FIG. 5 shows a schematic of a cross-section through the steam lock in the area where the thread bundle enters the lock. Steam lock 5 is bounded by side walls 10*a*, 10*b* as a channel 8. In the area where thread bundle 1 enters channel 8, there is also a sealing-tab arrangement 9. Sealing tabs 9 are made of an elastic material and mold to passing thread bundle 1. This ensures that the entry into the lock is closed between individual threads of the thread bundle. Width B of channel 8 is determined on the basis of the normally used threads of thread bundle 1. Normally width B should be no more than five times the diameter of a thread. Selecting width B in this way ensures that even if there are knots, the threads can easily pass through steam lock 5.

Figure 6:
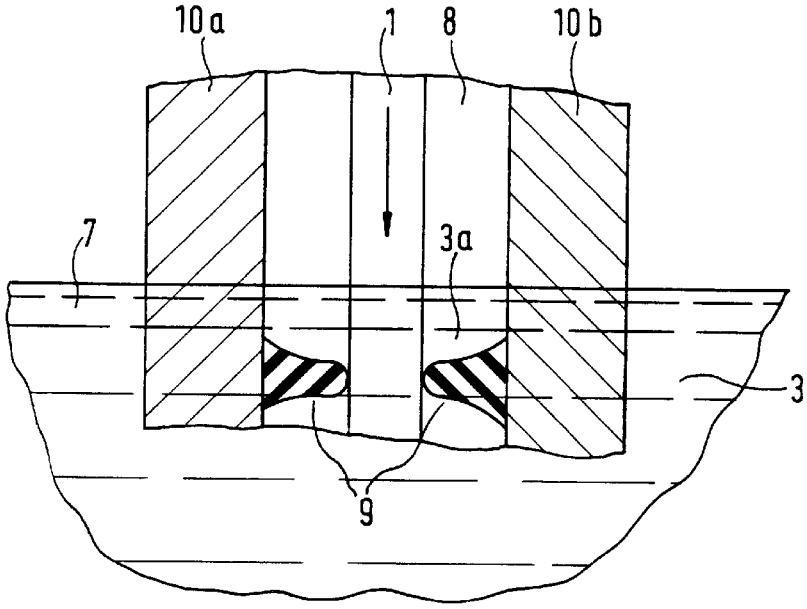
FIG. 6 shows a schematic of a sealing-tab arrangement in the dye liquor.

An identical mechanical lock with a sealing-tab arrangement 9 can be attached to the end of steam lock 5 or even in the area of the dye liquor itself (see FIG. 6).

Because of sealing-tab arrangement 9, which is located below surface 7 of dye liquor 3, a portion 3*a* of dye liquor 3 that is enclosed by steam lock 5 is kept from mixing with the rest of the dye liquor. Any oxygen that is still entrained by the thread bundle enters the area of dye liquor 3*a* and optionally oxidizes it. However, sealing-tab arrangement 9 prevents the oxygen from being passed on into the rest of dye liquor 3.

Figure 7:
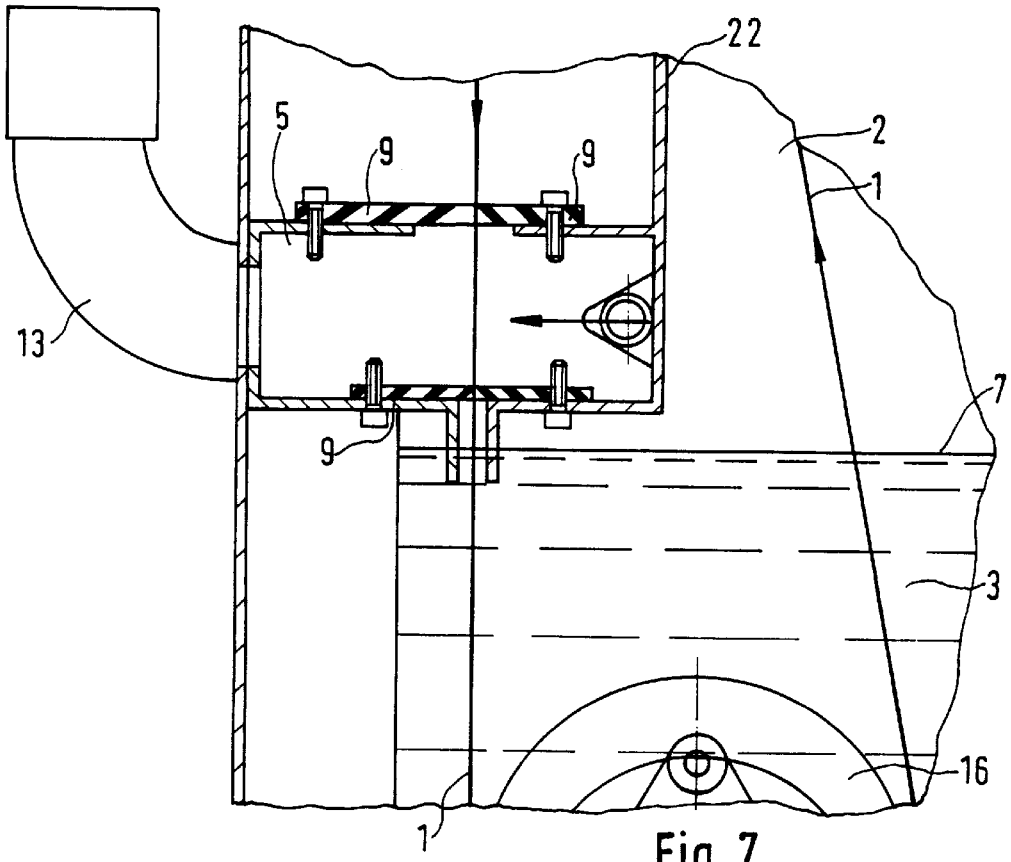
FIG. 7 shows a detail of the steam lock.

FIG. 7 shows in detail an embodiment of steam lock 5. The threads run between sealing tabs 9. Said tabs are made of an elastic material and are clamped by metal sheets to the outer wall of the lock.

We claim a:

1. Process for application of a vat dye to a thread bundle (1) in which thread bundle (1) is run through a steep bath (2) with a dye liquor (3) and then through a holding section (21) into a chamber (20) with a low-oxygen or oxygen-free atmosphere in order to cause the dye liquor to be absorbed into the threads, wherein, before it enters dye liquor (3), thread bundle (1) is run through a steam lock (5) that extends essentially up to surface (7) of dye liquor (3) and that is separated from chamber (20).

2. Process according to claim 1, wherein thread bundle (1) is run through steam lock (5) immediately before entering dye liquor (3).

3. Process according to claim 1, wherein in steam lock (5) thread bundle (1) is run through at least one sealing-tab arrangement (9).

4. Process according to claims 1, characterized by the fact that in the steam lock saturated steam with a temperature of 100° C. and a saturation of 100% is used, or by superheated steam with a temperature >100° C.

5. Device for application of a vat dye to a thread bundle (1), with a steep bath (2) to hold a dye liquor (3) and an arrangement (16) for guiding the thread bundle on a treatment path into and through dye liquor (3) and with a chamber (20) with an essentially oxygen-free atmosphere to cause the liquor to be absorbed into the threads of thread bundle (1) in holding section (21) in said chamber (20), wherein the device is equipped with a steam lock (5) through which the treatment path runs before entering dye liquor (3) and which is separated from chamber (20).

6. Device according to claim 5, wherein steam lock (5) is formed by a channel (8) because it extends at least to surface (7) of dye liquor (3).

7. Device according to claims 5, wherein long-side length (A) of steam lock (5) is adjustable.

8. Device according to claim 5, wherein there is at least one sealing-tab arrangement (9) in channel (8) to form steam lock (5).

9. Device according to claim 8, wherein a sealing-tab arrangement (9) is located in the area where thread bundle (1) enters steam lock (5) and a second sealing-tab arrangement (9) is located at the end of steam lock (5) below surface (7) of dye liquor (3).

10. Device according to claim 5, wherein width B of the steam lock is less than five times, and preferably approximately two to four times, the diameter of the threads of thread bundle (1).

11. Device according to claim 10, wherein channel (8) is bounded by two walls (10*a*, 10*b*), of which one side wall (10*a*) is designed as a continuation of side wall (11) of steep bath (2).

12. Device according to claim 11, wherein channel (8) is formed by two side walls (10*a*, 10*b*), whereby one side wall (10*b*) simultaneously forms a wall (22) of chamber (20).

* * * * *